United States Patent [19]

Stanek et al.

[11] Patent Number: 4,716,054

[45] Date of Patent: Dec. 29, 1987

[54] ACCELERATED FIXING OF CHROMATE-CONTAINING WOOD PRESERVATIVE SALTS

[75] Inventors: Richard Stanek, Mainz-Finthen; Hans-Norbert Marx, Buehl-Weitenung; Wendelin Hettler, Sinzheim-Muellhofen; Claus Wagner, Neumarkt, all of Fed. Rep. of Germany

[73] Assignee: Basf Aktiengesellschaft, Fed. Rep. of Germany

[21] Appl. No.: 838,782

[22] Filed: Mar. 12, 1986

[30] Foreign Application Priority Data

Mar. 22, 1985 [DE] Fed. Rep. of Germany ..... 3510364

[51] Int. Cl.[4] ..... B05D 3/12

[52] U.S. Cl. ..... 427/297; 427/325; 427/337; 427/343; 427/377; 427/379; 427/382; 427/440

[58] Field of Search ..... 427/297, 325, 337, 377, 427/440, 382, 379, 343

[56] References Cited

U.S. PATENT DOCUMENTS

| | | | |
|---|---|---|---|
| 2,235,822 | 3/1941 | Boardman | 427/440 |
| 3,080,212 | 3/1963 | Oberly et al. | 427/440 |
| 4,303,705 | 12/1981 | Kelso | 427/440 |
| 4,466,998 | 8/1984 | McIntyre et al. | 427/297 |

*Primary Examiner*—Janyce A. Bell

*Attorney, Agent, or Firm*—Keil & Weinkauf

[57] ABSTRACT

Accelerated fixing of chromate-containing wood preservative salts, in which freshly impregnated timbers are subjected to fixing with superheated steam, is carried out by a process wherein the freshly impregnated timbers are subjected beforehand to a heat treatment in which both the wood surface and the internal walls of the heating chamber are heated to 60°–100° C., preferably 80°–95° C., and the timbers are then treated with superheated steam in a conventional manner.

3 Claims, No Drawings

ACCELERATED FIXING OF CHROMATE-CONTAINING WOOD PRESERVATIVE SALTS

The present invention relates to a method for preventing or reducing possible washing out of water-soluble, fixing preservative salts directly after impregnation.

It is known that several weeks are required for the conversion of the water-soluble components of chromate-containing preservative salts to compounds which are difficult to wash out. In particular, sawn timber and round timber of small dimensions are seldom stored under cover during the fixing period. Rain falling on freshly impregnated timber may result in washing out of the active ingredients and hence in contamination of the environment. More and more frequently, chromate-containing wood preservative salts are being subjected to accelerated fixing by treatment with superheated steam after a pressure impregnation process.

In this procedure, spontaneous fixing is achieved in the outer region of the wood by the action of superheated steam at 110°-120° C. for one hour.

The formation of large amounts of condensate must be regarded as a serious disadvantage of this process. During the steam treatment, cooling of the superheated steam on the cold wood and on the kettle walls results in the formation of substantial amounts (about 3.5–4 $m^3$ per charge of impregnating solution in an impregnating kettle of 50 $m^3$ capacity) of condensation water which is contaminated with up to 0.5% by weight of preservative salts which have been washed out. Because of these residual amounts of preservative salts, the condensate cannot be discharged untreated into the waste water. Recycling to the storage tank results in undesirable dilution of the impregnating solution and increased sludge formation, which is attributable to the wood components washed out. Another disadvantage of this process is that the amount of preservative which becomes concentrated in the outer region of the wood is smaller in comparison with normally fixed timbers. This phenomenon is due to two factors. On the one hand, active ingredients are removed from the wood surface together with the dripping condensate, while on the other hand the rapidly forming fixing zone acts as a barrier layer, preventing the further supply of still mobile active ingredients from the interior of the wood to the surface.

The attempts to date to overcome the technical disadvantages of the superheated steam method have not produced any useful results. The obvious step of increasing the process temperature in order to reduce formation of condensate leads to pronounced cracking in round timbers. Similar results are obtained when the heat medium is replaced and a hot air treatment is used instead; the associated intensive drying leads to cracking of timbers of relatively large dimensions at above 100° C.

Changing to a milder treatment of the wood by means of a stream of warm air at only 60° C. again finally results in a fairly large amount of preservative being washed out in the first few days after fixing. The washout rates measured are not only substantially higher than in the case of fixing with superheated steam but are also higher than for freshly impregnated timbers which have not been subjected to any additional heat treatment. Thus, treatment of freshly impregnated timbers with warm air has precisely the opposite effect to that desired. The reason for this is the rapid removal of the water required for the fixing reaction.

It is an object of the present invention to avoid the serious disadvantages of the conventional superheated steam process:

We have found that this object is achieved by the novel process for the accelerated fixing of chromate-containing wood preservatives, wherein the freshly impregnated timbers are subjected to a two-stage treatment with different heat media according to the features of claim 1.

In Stage I, the freshly impregnated wood stack is heated under dry conditions until the temperature of the wood surface has increased to 60°-100° C., preferably 80°-95° C. Heating can be effected by means of, for example, hot air, hot waste gases, radiant heaters or IR lamps. In Stage II, the heated wood stack is brought to about 110° C. with superheated steam, experience showing that this temperature must then be maintained for about a further 30 minutes.

The heat treatment can also be carried out in a conventional drying chamber, but a technically preferable solution comprises the use of a special fixing chamber which permits exact control of the two phases of the process.

Corresponding experiments have shown that, when the process according to the invention is used, either no condensate at all is formed or only comparatively small residual amounts of from 0.2 to 0.5 $m^3$ (i.e. from 5 to 15% of the amount of condensate usually obtained) are present in the impregnating kettle. Analyses of the amounts of active ingredient in the edge zones have shown that there are no substantial differences compared with normally fixed comparative timbers not subjected to steam treatment.

Accelerated fixing of chromate-containing wood preservative salts is thus possible, without the reduction in the preservative fraction of the impregnate or disposal of chromate-containing waste waters playing an important role.

The practical experiments which follow illustrate the process according to the invention.

In an impregnating kettle of 50 m3 capacity, 20 $m^3$ of pine poles were impregnated in a conventional manner with a 3.6% strength solution of a chromium copper boron (CCB) salt. A flexible hot air line was then laid from a radiant heater to the end of the impregnating kettle, through the partially open chamber door. The stream of hot air flowed around the pine poles along their entire length and escaped, together with the steam, through the gap in the door. After heat treatment for about 30 minutes, an increase in the surface temperature at the rear end of the pine poles to 90°-95° C. and an increase in the temperature of the internal wall of the kettle to 70°-76° C. were measured by means of the mounted temperature sensors. In the direction of the kettle door, the surface temperature of the pine masts decreased continuously to 58°-65° C., and that of the inner wall of the kettle to 60°-64° C. After 30 minutes, the warm air treatment was discontinued, the kettle door was closed, and superheated steam at 120° C. was passed into the kettle via the vent valves. After a further 10 minutes, the sensors indicated that the surface temperature of the pine poles had increased to about 110° C., and this temperature was then maintained for a further 30 minutes.

After the steam treatment was complete, the wood surface was completely dry. Small amounts of about 0.2

$m^3$ of condensate were present at the bottom of the kettle.

In another experiment, the behavior of an 18 $m^3$ charge of spruce roundwood was tested under the same conditions. After a similar process (the increase in the temperature of the wood surface in the rear part of the impregnating kettle required about 5 minutes less than in Example I), the wood surface was dry in this case too, and no condensate formation took place at all here.

The two practical experiments, each of which were carried out after pressure impregnation, were intended to illustrate the usefulness of the novel process in practice, without restricting the range of uses. It is quite possible to carry out the heat treatment in a specially constructed fixing chamber instead; this chamber on the one hand would ensure substantially better process control and on the other hand would also permit the after-treatment of freshly impregnated timbers from other large-treatment scale industrial plants, such as open tanks, tanks for impregnating the base of posts, spray tunnels and the like.

We claim:

1. A process for the accelerated fixing of chromate-containing wood preservative salts, in which freshly impregnated timbers are subjected to fixing with superheated steam, wherein the freshly impregnated timbers are subjected first to a dry heat treatment in which both the wood surface and the internal walls of the heating chamber are heated to 60°-100° C. and the timbers are then treated with superheated steam in a conventional manner.

2. A process according to claim 1, wherein the heat treatment and fixing with superheated steam are carried out directly in the impregnating kettle after impregnation under superatmospheric pressure, under reduced pressure or under alternating pressures.

3. A process according to claim 1, wherein both the wood surface and the internal walls of the heating chamber are heated to 80°-95° C.

* * * * *